US008867953B2

(12) United States Patent
Kawashima

(10) Patent No.: US 8,867,953 B2
(45) Date of Patent: Oct. 21, 2014

(54) IMAGE FORMING APPARATUS AND SEPARATION DEVICE FOR TONER COLLECTION

(71) Applicant: Fuji Xerox Co., Ltd., Tokyo (JP)

(72) Inventor: Shinji Kawashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 2 days.

(21) Appl. No.: 13/867,620

(22) Filed: Apr. 22, 2013

(65) Prior Publication Data

US 2014/0112681 A1 Apr. 24, 2014

(30) Foreign Application Priority Data

Oct. 24, 2012 (JP) ..... 2012-235156

(51) Int. Cl.
*G03G 15/00* (2006.01)
*G03G 21/12* (2006.01)
*G03G 21/10* (2006.01)

(52) U.S. Cl.
CPC ..... *G03G 21/10* (2013.01); *G03G 21/12* (2013.01); *G03G 15/00* (2013.01)
USPC ..... 399/99; 399/397

(58) Field of Classification Search
CPC G03G 15/6529; G03G 15/657; G03G 21/206
USPC ..... 399/92, 93, 98, 99, 397
See application file for complete search history.

(56) References Cited

U.S. PATENT DOCUMENTS

2006/0098998 A1* 5/2006 Yamada et al. ..... 399/53
2011/0116826 A1* 5/2011 Nishikawa ..... 399/92
2011/0211859 A1* 9/2011 Shimoyama et al. ..... 399/93

FOREIGN PATENT DOCUMENTS

JP 10-222035 A 8/1998

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

An image forming apparatus includes an image forming section that forms an image with toner, a housing that houses the image forming section, and a toner collection mechanism. The toner collection mechanism includes a suction unit that sucks the toner, which leaves the image forming section and is flying, and air, and a separation unit separating the toner from air. The separation unit includes a separator that collects the toner and allows air to pass therethrough, a casing that houses the separator that has an opening, through which the toner and air flow, and a joining unit that is disposed along an edge of the opening and joins the casing and the housing to each other. The joining unit projects upward beyond the edge of the opening at least in the lower portion of the opening, thereby forming a space that allows the toner to be trapped.

6 Claims, 10 Drawing Sheets

IMAGE FORMING APPARATUS AND SEPARATION DEVICE FOR TONER COLLECTION

CROSS-REFERENCE TO RELATED APPLICATIONS

This application is based on and claims priority under 35 USC 119 from Japanese Patent Application No. 2012-235156 filed Oct. 24, 2012.

BACKGROUND

Technical Field

The present invention relates to an image forming apparatus and a separation device for toner collection.

SUMMARY

According to an aspect of the present invention, an image forming apparatus includes an image forming section that forms an image with toner, a housing that houses the image forming section, and a toner collection mechanism. The toner collection mechanism includes a suction unit that sucks the toner, which leaves the image forming section and is flying, along with air and a separation unit that separates the toner, which is sucked by the suction unit, from air. The separation unit of the toner collection mechanism includes a separator that collects the toner and allows air to pass through the separator, a casing that houses the separator and has an upper side and an opening that has an edge and a lower portion and allows the toner and air flowing through the opening, and a joining unit that is disposed along the edge of the opening and joins the casing and the housing to each other. In the image forming apparatus, the joining unit projects beyond the edge of the opening at least in the lower portion of the opening toward the upper side of the casing, thereby forming a space that allows the toner to be trapped in the space.

BRIEF DESCRIPTION OF THE DRAWINGS

Exemplary embodiments of the present invention will be described in detail based on the following figures, wherein.

DETAILED DESCRIPTION

Exemplary embodiments according to the present invention will be described in detail below with reference to the accompanying drawings.

Description of Image Forming Apparatus

Figure 1:
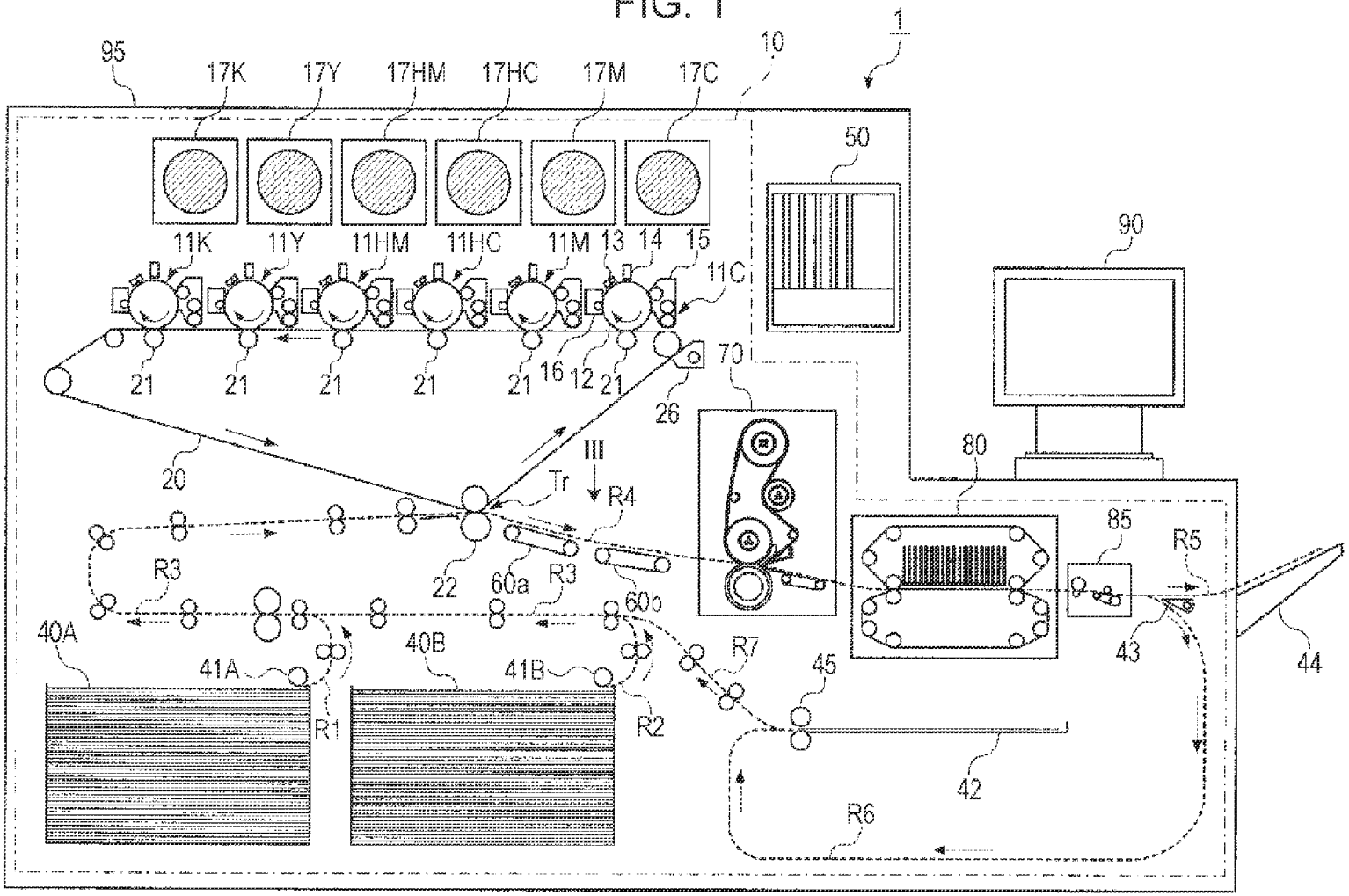
FIG. 1 illustrates an image forming apparatus according to an exemplary embodiment.

FIG. 1 illustrates an image forming apparatus 1 according to an exemplary embodiment.

The image forming apparatus 1 is a so-called "tandem type" color printer and includes an image forming section 10, a controller 50, a user interface (UI) unit 90, and a housing 95. The image forming section 10 forms an image on a recording medium (sheet of paper) in accordance with printing data. The controller 50 performs operational control of the entire image forming apparatus 1, communication with, for example, a personal computer (PC) or the like, image processing performed corresponding to printing data, and so forth. The UI unit 90 receives operational input from the user and displays various information for the user. The housing 95 houses the image forming section 10.

Description of Image Forming Unit

The image forming section 10 is a functional unit that forms images using, for example, an electrophotographic system and forms images using toner. The image forming section 10 includes six image forming units 11C, 11M, 11HC, 11HM, 11Y, and 11K (hereafter may also be referred to as "image forming units 11"), an intermediate transfer belt 20, and first transfer rollers 21. The image forming units 11 are arranged side by side and serve as examples of a toner image forming unit. Toner images of respective colors having been formed on photoconductor drums 12 of the corresponding image forming units 11 are transferred onto the intermediate transfer belt 20. The first transfer rollers 21 transfer (first transfer) onto the intermediate transfer belt 20 the toner images of the respective colors having been formed in the corresponding image forming units 11. The image forming section 10 also includes a second transfer roller 22 and a fixing unit 70. The second transfer roller 22 collectively transfers (second transfer) onto a sheet the toner images of the respective colors, which have been transferred onto the intermediate transfer belt 20 such that the toner images are superposed with one another. The fixing unit 70 serves as an example of a fixing component (fixing device) that fixes the toner images of the respective colors having been transferred onto the sheet through the second transfer. A region, in which the second transfer roller 22 is disposed and the toner images of the respective colors on the intermediate transfer belt 20 are transferred onto the sheet through second transfer, is referred to as a "second transfer region Tr" hereafter.

The image forming section 10 also includes transport devices 60*a* and 60*b* (may also be referred to as "transport devices 60" hereafter), a cooling unit 80, a curl correction unit 85, and a toner collection unit (not shown). The transport devices 60 transport the sheet from the second transfer region Tr to the fixing unit 70. The cooling unit 80 is an example of a cooling device that cools the toner images of the respective colors on the sheet, the toner images having been fixed onto the sheet by the fixing unit 70, so as to facilitate fixing of the toner images onto the sheet. The curl correction unit 85 corrects twist (curl) of the sheet. The toner collection unit is an example of a toner collection device (toner collection mechanism) that collects toner leaving the image forming section 10 and is flying. The details of the toner collection unit will be described later. In the image forming apparatus 1 according to the present exemplary embodiment, a transfer unit that transfers toner images onto the sheet includes the intermediate transfer belt 20, the first transfer rollers 21, and the second transfer roller 22.

Description of Image Forming Unit

Each of the image forming units 11 includes as functional members, for example, the photoconductor drum 12, a charger 13, an exposure unit 14, a developing device 15, and a cleaner 16. An electrostatic latent image is formed and then a toner image of a corresponding one of the colors is formed on the photoconductor drum 12. The charger 13 charges the surface of the photoconductor drum 12 to a predetermined potential. The exposure unit 14 exposes in accordance with image data the photoconductor drum 12 having been charged by the charger 13. The developing device 15 develops the electrostatic latent image having been formed on the photoconductor drum 12 with the toner of a corresponding one of the colors. The cleaner 16 cleans the surface of the photoconductor drum 12 after the toner image has been transferred.

The developing device 15 of each image forming unit 11 is connected to a corresponding one of toner containers 17C, 17M, 17HC, 17HM, 17Y, and 17K (may also be referred to as "toner containers 17" hereafter) through a transportation path (not shown). The toner containers 17 store toners of the respective colors. The developing devices 15 are replenished with the toners of the respective colors transported from the toner containers 17 by using replenishment screws (not shown) provided in the respective toner transportation paths.

The structures of the image forming units 11 are substantially the same as one another except for the toners contained in the respective developing devices 15. Toner images of cyan (C), magenta (M), high-chroma cyan (HC), high-chroma magenta (HM), yellow (Y), and black (K) are formed by the respective image forming units 11. Here, the HC color refers to a cyan color that has a cyan base hue, has a brighter color tone than the C color, and has a comparatively high chroma. The HM color refers to a magenta color that has a magenta base hue, has a brighter color tone than the M color, and has a comparatively high chroma.

Description of Sheet Transport System of Image Forming Apparatus

The image forming section 10 has a sheet transport system that includes plural (two in the present exemplary embodiment) sheet containers 40A and 40B and pickup rollers 41A and 41B. The sheet containers 40A and 40B contain sheets. The pickup rollers 41A and 41B pick up sheets contained in the sheet containers 40A and 40B and transport the sheets. The sheet transport system has a first transport path R1 and a second transport path R2. A sheet picked up from the sheet container 40A is transported through the first transport path R1, and a sheet picked from the sheet container 40B is transported through the second transport path R2. The image forming section 10 also has a third transport path R3. Sheets from the sheet containers 40A and 40B are transported through the third transport path R3 to the second transfer region Tr. Furthermore, the image forming section 10 has a fourth transport path R4 and a fifth transport path R5. A sheet, onto which toner images of respective colors have been transferred in the second transfer region Tr, is transported through the fourth transport path R4 so as to pass through the fixing unit 70, the cooling unit 80, and the curl correction unit 85. The sheet from the curl correction unit 85 is transported toward a sheet stack unit 44 through the fifth transport path R5. The sheet stack unit 44 is provided in a sheet output section of the image forming apparatus 1.

Transport rollers and transport belts are provided along the first to fifth transport path R1 to R5, thereby sequentially transporting received sheets.

Description of Duplex Printing Transport System

The image forming section 10 has a duplex printing transport system that includes an intermediate sheet container 42 and has a sixth transport path R6 and a seventh transport path R7. The intermediate sheet container 42 temporarily holds a sheet, onto a first side of which toner images of the respective colors have been fixed by the fixing unit 70. A sheet from the curl correction unit 85 is transported toward the intermediate sheet container 42 through the sixth transport path R6. A sheet contained in the intermediate sheet container 42 is transported toward the third transport path R3 through the seventh transport path R7. The image forming section 10 also includes a sheet sorting mechanism 43 and a pickup roller 45. The sheet sorting mechanism 43 is disposed downstream of the curl correction unit 85 in the sheet transport direction and selectively directs the sheets to the fifth transport path R5, through which the sheets are transported toward the sheet stack unit 44, and to the sixth transport path R6, through which the sheets are transported toward the intermediate sheet container 42. The pickup roller 45 picks up a sheet contained in the intermediate sheet container 42 and transports the sheet toward the seventh transport path R7.

Description of Operation of Image Forming Apparatus

Next, basic image forming operation of the image forming apparatus 1 according to the present exemplary embodiment is described with reference to FIG. 1.

Each of the image forming units 11 of the image forming section 10 forms a toner image of a corresponding one of the C, M, HC, HM, Y, and K colors through an electrophotographic process using the aforementioned functional members. The toner images of the respective colors formed in the image forming units 11 are sequentially transferred onto the intermediate transfer belt 20 by the respective first transfer rollers 21 through first transfer, thereby forming a combined toner image, in which the toners of the respective colors are superposed with one another. The combined toner image on the intermediate transfer belt 20 is transported to the second transfer region Tr, where the second transfer roller 22 is disposed, as the intermediate transfer belt 20 moves (in the direction of arrows).

In the sheet transport system, the pickup roller 41A or 41B is rotated at timing at which image formation in the image forming units 11 is started. A sheet specified with, for example, the UI unit 90, is picked up from the sheet container 40A or 40B by a corresponding one of the pickup rollers 41A and 41B. The sheet picked up by the pickup roller 41A or 41B is transported through one of the first and second transport paths R1 and R2 and the third transport path R3 and reaches the second transfer region Tr.

In the second transfer region Tr, toner images that form the combined toner image held on the intermediate transfer belt 20 are collectively transferred onto the sheet through second transfer by a transfer electric field formed by the second transfer roller 22.

After that, the sheet onto which the combined toner image has been transferred is separated from the intermediate transfer belt 20 and transported to the fixing unit 70 through the fourth transport path R4. The combined toner image on the sheet having been transported to the fixing unit 70 undergoes a fixing process performed by the fixing unit 70 and is fixed onto the sheet. The sheet onto which the fixed image has been formed is cooled by the cooling unit 80, and curling of the sheet is corrected by the curl correction unit 85. After that, the sheet having passed through the curl correction unit 85 is directed to the fifth transport path R5 in the case of simplex printing by the sheet sorting mechanism 43 and transported toward the sheet stack unit 44.

Toner that still adheres to the photoconductor drums 12 after first transfer has been performed (first transfer residual toner) and toner that still adheres to the intermediate transfer belt 20 after second transfer has been performed (second transfer residual toner) are respectively removed by the cleaners 16 and a belt cleaner 26.

In the case of duplex printing, a sheet, onto the first side of which a fixed image has been formed through the above-described process, passes through the curl correction unit 85, and then is directed to the sixth transport path R6 by the sheet sorting mechanism 43 and transported toward the intermediate sheet container 42 through the sixth transport path R6. The pickup roller 45 is rotated again at timing at which image formation on the second side of the sheet is started in the image forming units 11, and the sheet is picked up from the intermediate sheet container 42. The sheet picked up by the pickup roller 45 is transported through the seventh transport path R7 and the third transport path R3 and reaches the second transfer region Tr.

In the second transfer region Tr, as is the case with the first side, toner images of the respective colors for the second side, the images being held on the intermediate transfer belt 20, are collectively transferred onto the sheet through second transfer by the transfer electric field formed by the second transfer roller 22.

The sheet, onto both sides of which toner images have been transferred, is transported to the fixing unit 70, in which the toner images on both sides of the sheet are fixed onto the sheet, and cooled in the cooling unit 80. Furthermore, curling of the sheet is corrected by the curl correction unit 85 as is the case with printing on the first side. After that, the sheet having passed through the curl correction unit 85 is directed to the fifth transport path R5 by the sheet sorting mechanism 43 and transported toward and ejected to the sheet stack unit 44.

Thus, an image forming process performed by the image forming apparatus 1 is repeated for as many cycles as the number of sheets for which printing is to be performed.

Description of Transport Device

Figure 2:
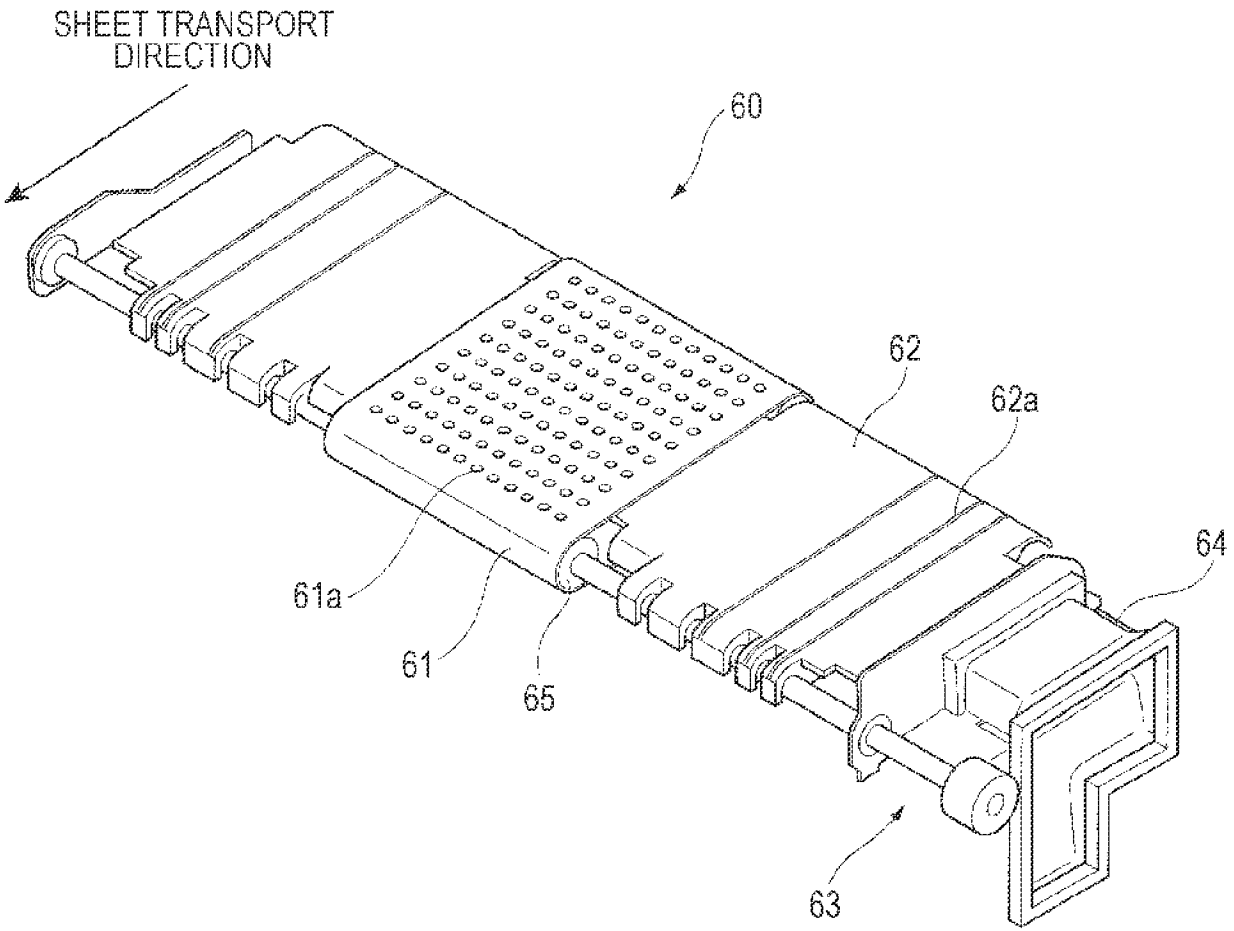
FIG. 2 illustrates one of transport devices.

FIG. 2 illustrates one of the transport devices 60.

The transport devices 60 according to the present exemplary embodiment include the transport devices 60A and 60B, which have the structures similar to each other.

As illustrated in FIG. 2, the transport devices 60 each include a rotating belt 61 and sheet guide units 62. The rotating belt 61 is an example of a rotating member that transports a sheet from the second transfer region Tr to the fixing unit 70. The sheet guide units 62 that each serve as an example of a recording medium guide member that guides a sheet are provided on both outer sides of the rotating belt 61 in the rotational axis direction of the rotating belt 61. Each transport device 60 also includes a drive unit 63 and a duct 64. The drive unit 63 rotates the rotating belt 61. The sheet is sucked to the rotating belt 61 by negative pressure. An airflow is caused to pass through the duct 64 by operation of a fan 110 (see FIG. 3) so as to generate the negative pressure. The fan 110 will be described later.

The rotating belt 61 is formed of an elastic material such as rubber. The rotating belt 61 is looped over a pair of rotating rollers 65 and is rotated as the rotating rollers 65 are rotated. One of the rotating rollers 65 is connected to the drive unit 63. Thus, when a drive force is generated by the drive unit 63, the rotating belt 61 is rotated via the rotating roller 65. By the rotation of the rotating belt 61, the sheet may be transported from the second transfer region Tr to the fixing unit 70.

The rotating belt 61 has regularly arranged plural holes 61*a*. The above-described duct 64 is connected to the holes 61*a*. When the fan 110 is rotated, air is sucked from the holes 61*a* through the duct 64. Accordingly, when a sheet is transported on the rotating belt 61, negative pressure is generated between the sheet and the rotating belt 61. Thus, the sheet is transported while being sucked to the rotating belt 61.

The sheet guide units 62 have ribs 62*a*, which are examples of a protrusion formed in the sheet transport direction. The sheet is transported while being in contact with the ribs 62*a*. Thus, the sheet may be transported while a frictional force applied thereto is decreased.

Description of Toner Collection Unit

Figure 3:
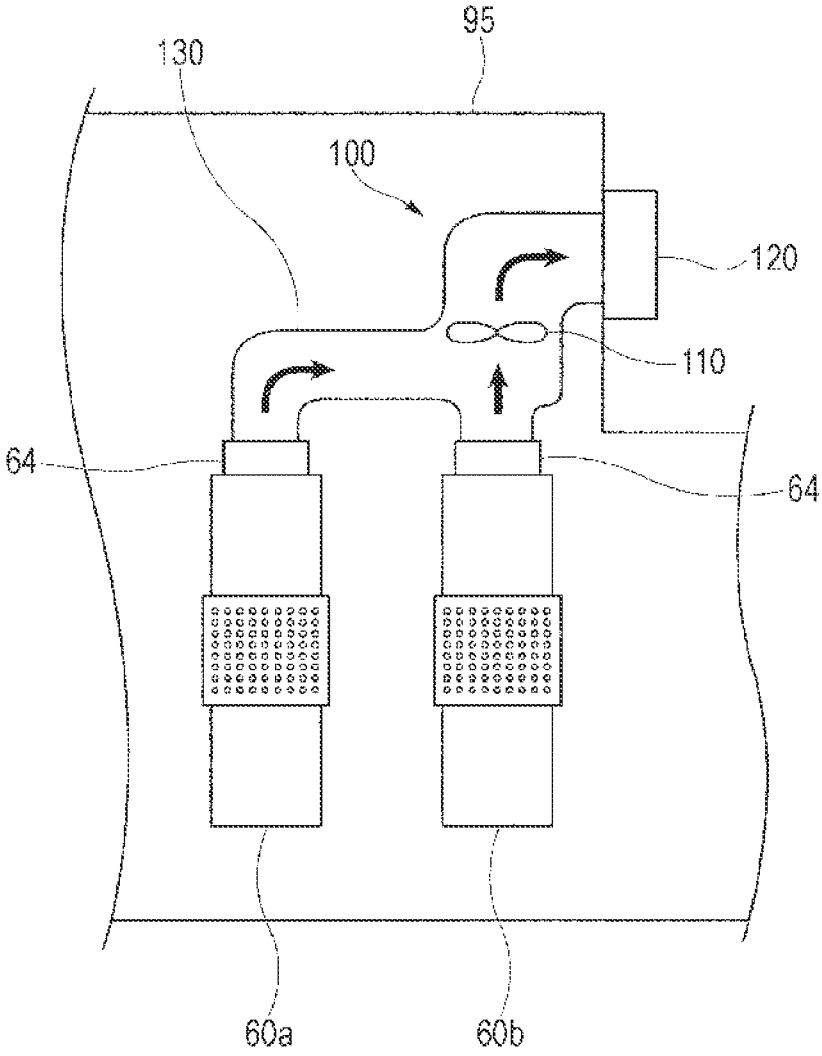
FIG. 3 illustrates the connection relationship between the transport devices and a toner collection unit seen in the III direction in FIG. 1.

FIG. 3 illustrates connection relationship between the transport devices 60*a* and 60*b* and a toner collection unit 100 seen in the III direction in FIG. 1.

As illustrated in FIG. 3, the toner collection unit 100 includes the fan 110, a filter unit 120, and a duct 130. The fan 110 is an example of a suction unit that sucks toner along with air. The toner leaves the image forming section 10, which forms an image with toner, and is flying. The filter unit 120 is an example of a separation unit (separation device for toner collection) that separates the toner from the air, which are sucked by the fan 110. The toner and air sucked by the fan 110 flow through the duct 130.

Here, the filter unit 120 is attached to an outer wall of the housing 95, which is an example of an attachment target. The filter unit 120 is connected to the transport devices 60*a* and 60*b*, which are housed inside the housing 95, through the duct 130. More specifically, the duct 130 is connected to the ducts 64 of the transport devices 60*a* and 60*b* on the transport devices 60*a* and 60*b* side. The fan 110 is disposed between the filter unit 120 and the transport devices 60*a* and 60*b* inside the duct 130.

Here, when the fan 110 is operated, airflows moving from the transport devices 60*a* and 60*b* toward the filter unit 120 are generated. The airflows pass through the ducts 64 of the transport devices 60*a* and 60*b* and the duct 130 of the toner collection unit 100 and reach the filter unit 120. The sucked toner and air are separated from each other by the filter unit 120. At this time, the toner is collected by the filter unit 120. The air passes through the filter unit 120 and is exhausted to the outside of the filter unit 120.

With the toner collection unit 100 having the above-described structure, the toner, which leaves the image forming section 10 and is flying in the housing 95, may be removed from the inside of the image forming apparatus 1. Thus, adherence of flying toner to sheets and mechanical components inside the image forming apparatus 1 may be suppressed, and accordingly, images having improved quality may be formed.

Description of Filter Unit Attachment State

Figure 4B:
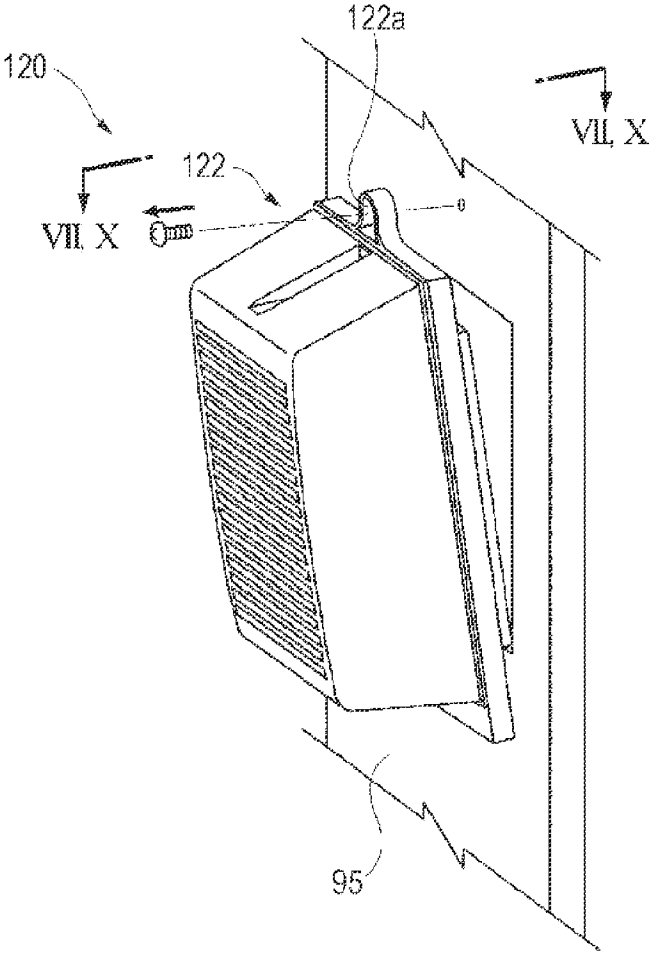
FIGS. 4A and 4B illustrate examples of states in which a filter unit is attached to a housing.
Figure 4A:
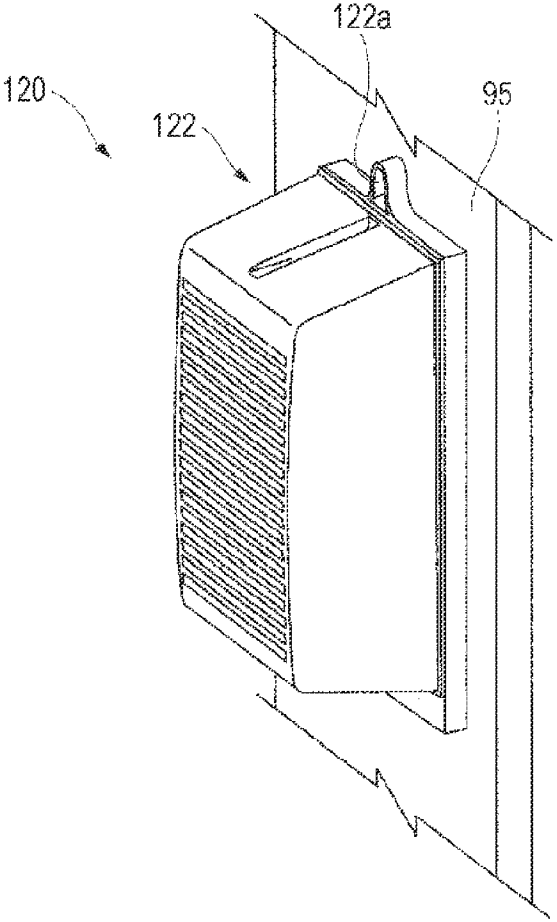

FIGS. 4A and 4B illustrate examples of states in which the filter unit 120 is attached to the housing 95.

In FIG. 4A, the filter unit 120 is attached to the housing 95. In FIG. 4B, the filter unit 120 is being detached from the housing 95.

In order to attach the filter unit 120 to the housing 95 as illustrated in FIG. 4A, a screw is inserted through a hole 122*a* provided in a filter covering 122 of the filter unit 120. By fastening this screw, the filter unit 120 is secured to the housing 95.

Here, a lower end portion of the filter covering 122 is, as will be described later, inserted into the housing 95 in order to attach the filter unit 120. With this structure, an upper end portion of the filter covering 122 is rotatable about the lower end portion of the filter covering 122. Thus, in order to detach the filter unit 120 from the housing 95, the screw inserted through the hole 122*a* is initially removed. Then, as illustrated in FIG. 4B, the upper end portion of the filter covering 122 is rotated about the lower end portion of the filter covering 122 so that the upper end portion of the filter covering 122 is separated from the housing 95. Next, by drawing the lower end portion of the filter covering 122 having been inserted into the housing 95 from the housing 95, the filter unit 120 may be detached from the housing 95.

In order to attach the filter unit 120 to the housing 95, it is sufficient that the above-described procedure be reversed. In the present exemplary embodiment, the filter unit 120 is attached to or detached from the housing 95 in the above-described procedure.

First Exemplary Embodiment of Filter Unit

Next, a first exemplary embodiment of the filter unit 120 is described.

Figure 5:
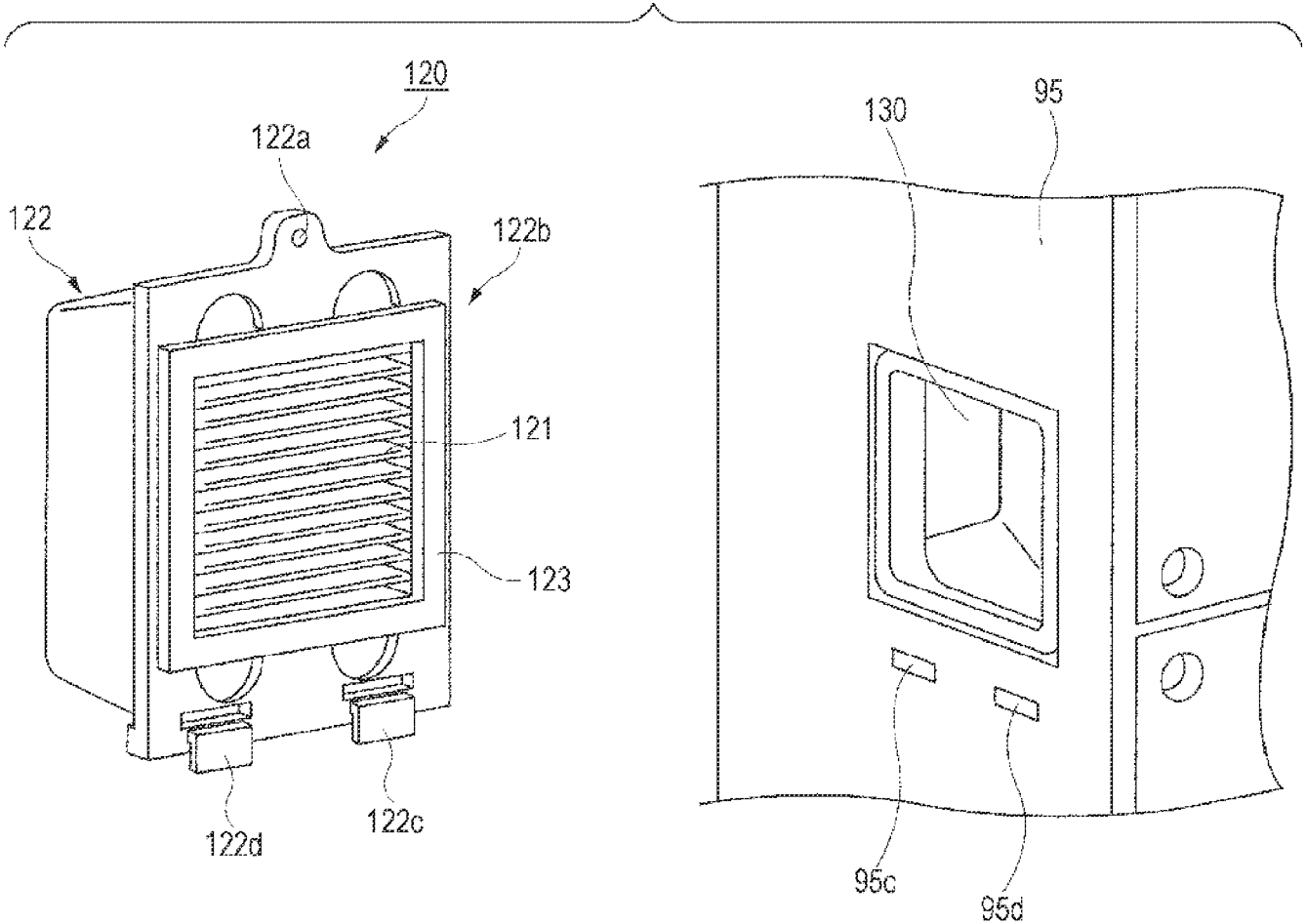
FIG. 5 illustrates the filter unit detached from the housing.

FIG. 5 illustrates the filter unit 120 detached from the housing 95.

As illustrated in FIG. 5, the filter unit 120 includes a filter 121, the filter covering 122, and a joining member 123.

The filter 121 is an example of a separator, and formed of, for example, a non-woven fabric or the like. With the filter 121, toner contained in the airflows may be collected. The filter 121 allows air to pass therethrough. Air having passed through the filter 121 is exhausted to the outside of the filter unit 120.

The filter covering 122 has an opening 122*b*, through which toner and air flow, and functions as an example of a casing, in which the filter 121 is housed.

The filter covering 122 has protrusions 122*c* and 122*d* in its lower portion. The protrusions 122*c* and 122*d* are respectively insertable into holes 95*c* and 95*d* formed in the housing 95. Thus, in order to attach the filter unit 120 to the housing 95, the lower end portion of the filter covering 122 is secured by respectively inserting the protrusions 122*c* and 122*d* into the holes 95*c* and 95*d*. Furthermore, by securing the upper end portion of the filter covering 122 with the screw inserted through the hole 122*a*, the entirety of the filter unit 120 may be secured to the housing 95.

When the screw is not inserted through the hole 122*a*, the upper end portion of the filter covering 122, the upper end portion having the hole 122*a* formed therein, is rotatable about the protrusions 122*c* and 122*d*. That is, operation illustrated in FIG. 4B, in which the upper end portion of the filter covering 122 is rotated about the lower end portion of the filter covering 122 so that the upper end portion of the filter covering 122 is separated from the housing 95, is achieved with the protrusions 122*c* and 122*d*.

Figure 6:
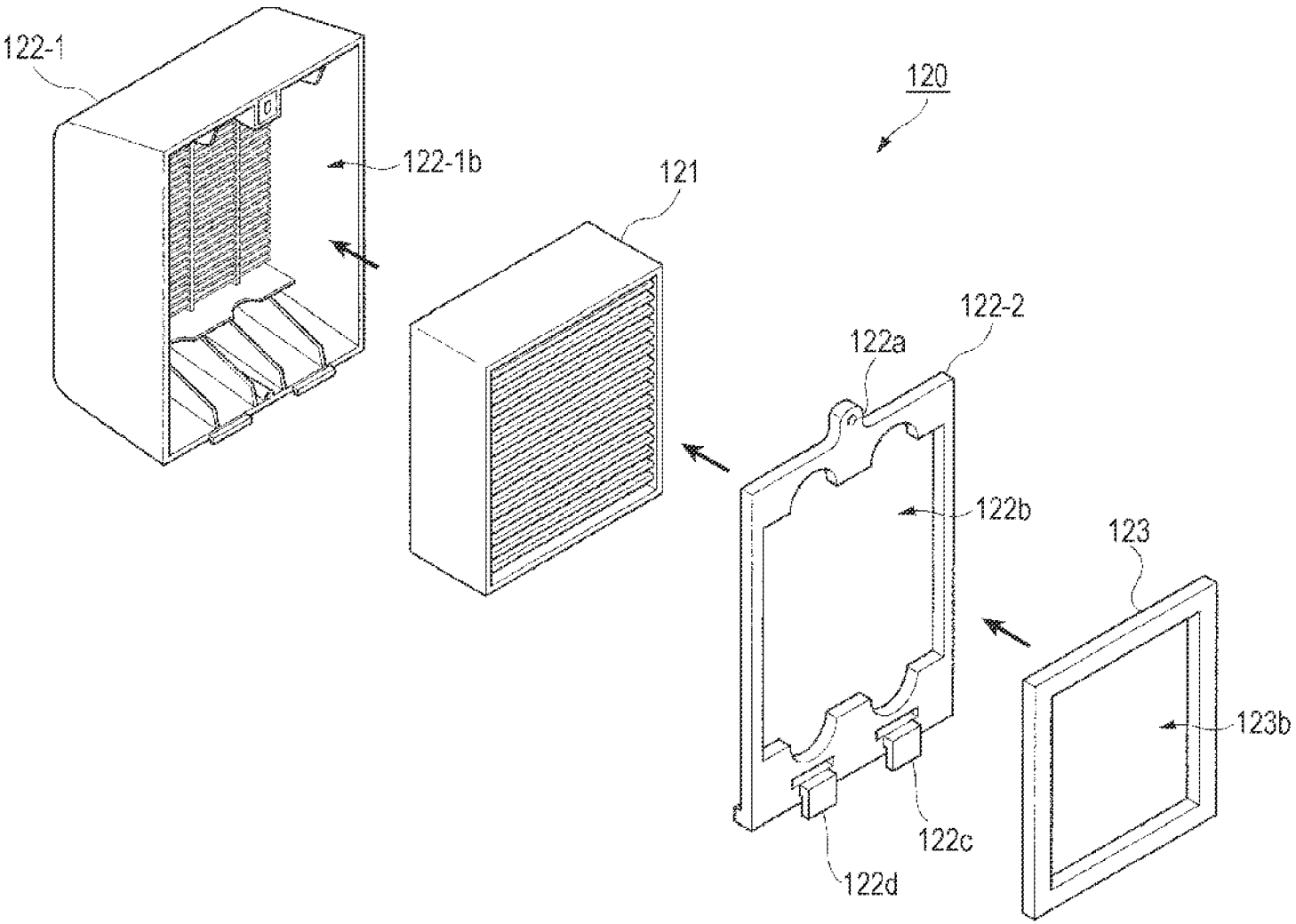
FIG. 6 illustrates a first structural example of components of the filter unit.

FIG. 6 illustrates a first structural example of the components of the filter unit 120.

In the present exemplary embodiment, the filter covering 122 includes two members, that is, a covering body 122-1 and covering frame 122-2. The covering body 122-1 is an example of a first casing member that has a hole 122-1*b*, which opens toward the housing 95 side, and houses the filter 121 attached thereto through the hole 122-1*b*. The covering frame 122-2 is an example of a second casing member detachably attached to the covering body 122-1. The covering body 122-1 and the covering frame 122-2 are formed by, for example, molding resin or the like. The covering body 122-1 and the covering frame 122-2 may be connected to and separated from each other. In order to connect the covering body 122-1 and the covering frame 122-2 to each other, the covering frame 122-2 may be, for example, engaged with the covering body 122-1. The covering frame 122-2 may be secured to the covering member 122-1 with screws. The hole 122*a* used to attach the filter covering 122 to the housing 95, the protrusions 122*c* and 122*d*, and the opening 122*b* that allows toner and air to pass therethrough are provided on the covering frame 122-2 side.

In this structure, as illustrated in FIG. 6, the filter 121 is housed through the hole 122-1*b* formed on the housing 95 (see FIG. 5) side of the covering member 122-1. The covering frame 122-2 is attached to the covering member 122-1 with the filter 121 housed in the covering member 122-1. At this time, since the size of the opening 122*b* of the covering frame 122-2 is smaller than that of the outer periphery of the filter 121, the filter 121 is pressed toward the covering member 122-1 side by the covering frame 122-2. Thus, the filter 121 is secured in the filter covering 122.

Also in the present exemplary embodiment, the joining member 123 that serves as an example of a joining unit, which is disposed along the edge of the opening 122*b* and joins the filter covering 122 to the housing 95, is provided.

The joining member 123 is an elastic body formed of urethane or the like. The joining member 123 has a hole 123*b* that allows toner and air to flow therethrough as is the case with the opening 122*b* of the filter covering 122. In order to attach the filter unit 120 to the housing 95, the joining member 123 is pinched between and pressed against the covering frame 122-2 of the filter covering 122 and the housing 95. By pinching the joining member 123 between the covering frame 122-2 and the housing 95 as described above, the filter unit 120 may be attached to the housing 95 without a gap formed therebetween.

The joining member 123 is integrated with the covering frame 122-2 of the filter covering 122 by being connected to the covering frame 122-2 with double-faced tape, adhesive, or the like. That is, in this case, the covering frame 122-2 faces the hole 122-1*b* of the covering member 122-1 on one side, has the opening 122*b* on the other side, and is connected to the joining member 123 disposed along the edge of the opening 122*b*. In order to attach or detach the filter 121 in an operation such as replacement of the filter 121, the covering frame 122-2 is attached and detached with the joining member 123 connected thereto. As a result, attachment and detachment of the filter 121 may be further facilitated. Furthermore, the filter covering 122 is separated into the covering member 122-1 and the covering frame 122-2 and the filter 121 is detached from the covering member 122-1 side. Thus, damage to the joining member 123 caused when the filter 121 is attached or detached may be decreased. In contrast, in the case where, in the filter covering 122, the covering member 122-1 and the covering frame 122-2 are integrated with each other, the filter 121 is attached or detached through the joining member 123. Thus, when the filter 121 is attached or detached, the joining member 123 is easily damaged.

Figure 7:
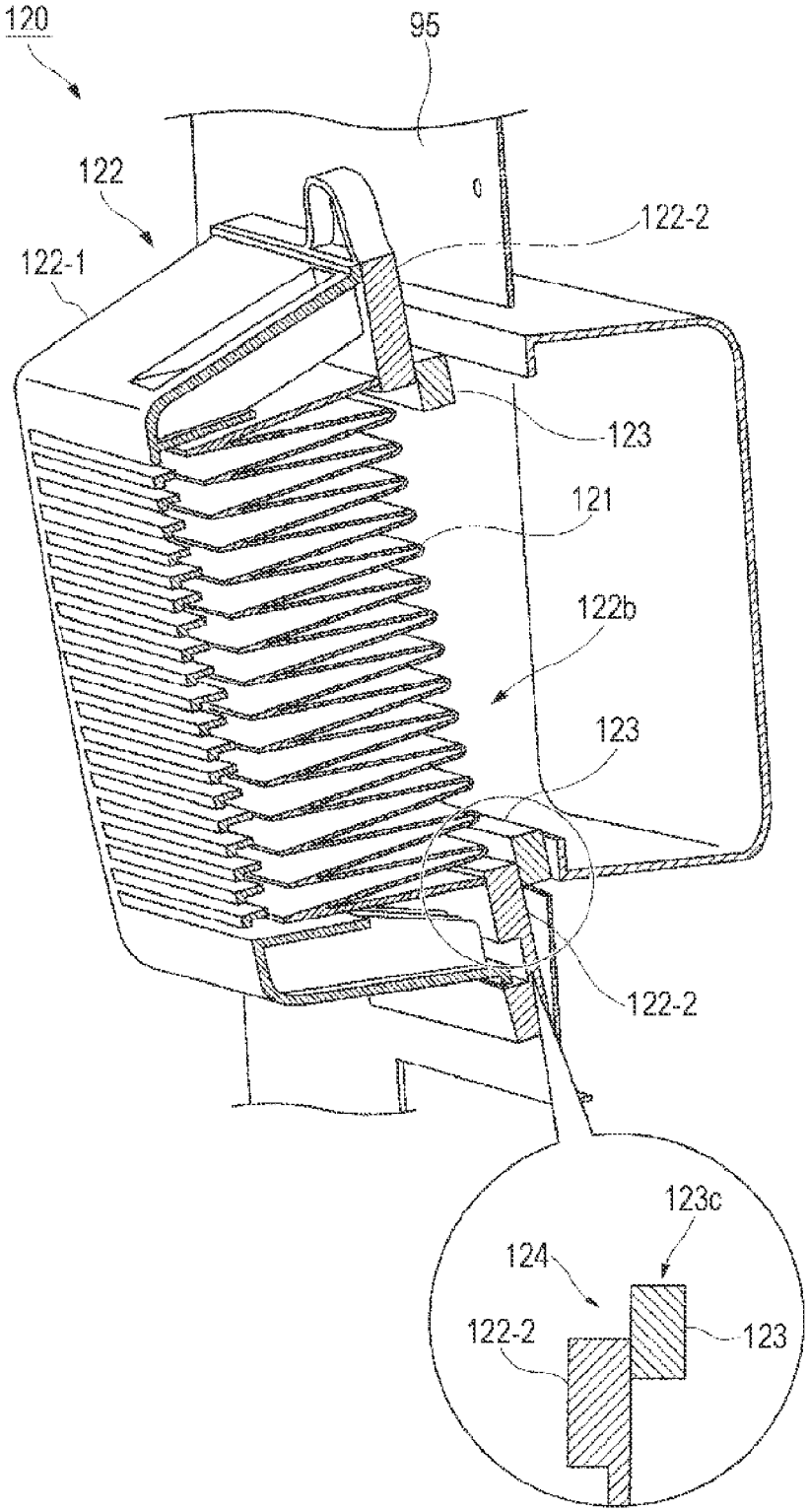
FIG. 7 is a sectional view of the filter unit according to an exemplary embodiment taken along line VII-VII in FIG. 4B.

FIG. 7 is a sectional view of the filter unit 120 according to the present exemplary embodiment taken along line VII-VII in FIG. 4B.

As illustrated in FIG. 7, in the present exemplary embodiment, the joining member 123 has a projection 123*c* that projects beyond the edge of the opening 122*b* in a lower portion of the opening 122*b* toward an upper side of the filter covering 122. With the projection 123*c*, a space 124, in which toner is trapped, is formed.

In particular, when the filter 121 is detached in order to, for example, replace the filter 121, toner collected by the filter 121 tends to drop and spill out of the filter unit 120. Here, with the space 124, toner having dropped is trapped in the space 124. Thus, spilling of the toner to the outside of the filter unit 120 may be suppressed. Also in the present exemplary embodiment, the space 124 is formed by the joining member 123 projecting beyond the edge of the opening 122*b* in the lower portion of the opening 122*b* toward the upper side of the filter covering 122. Thus, the space 124 may be formed in a simple method without using a dedicated separate member.

Figure 8:
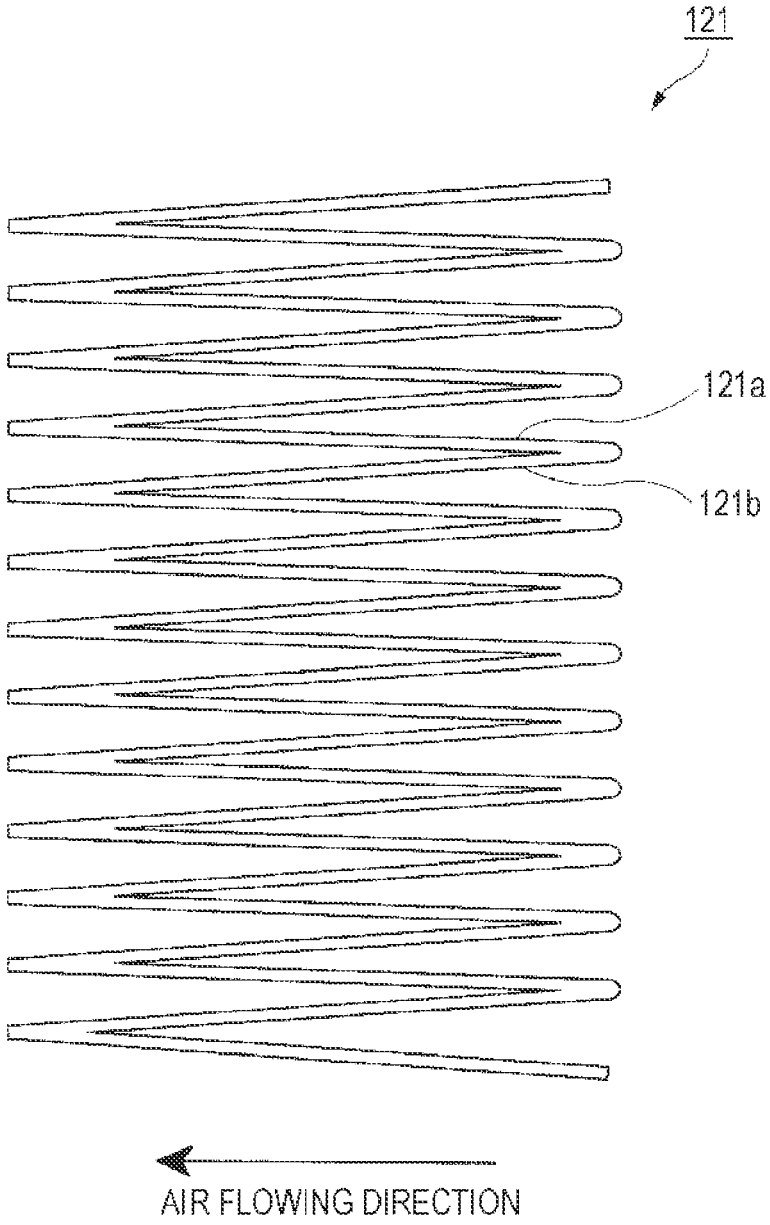
FIG. 8 illustrates the structure of a filter in more detail.

FIG. 8 illustrates the structure of the filter 121 in more detail.

As illustrated in FIG. 8, the filter 121 is folded back and forth in an air flowing direction so as to have a zigzag shape. Surfaces that form the zigzag shape include horizontal surfaces 121*a* that are substantially horizontal when the filter unit 120 is attached to the housing 95 and inclined surfaces 121*b* that are inclined when the filter unit 120 is attached to the housing 95. The horizontal and inclined surfaces 121*a* and 121*b* are alternately arranged. In the present exemplary embodiment, with the horizontal surfaces 121*a*, toner is unlikely to drop due to gravity. Thus, when the filter 121 is detached, spilling of toner to the outside of the filter unit 120 may be suppressed.

In the present exemplary embodiment, as illustrated in FIG. 4B, in the filter unit 120, the upper end portion of the filter covering 122 is rotated about the lower end portion of the filter covering 122 so that the upper end portion of the filter covering 122 is separated from the housing 95, thereby the filter unit 120 is detached.

Thus, toner trapped on the horizontal surfaces 121*a* of the filter 121 and the space 124 is, due to the effect of gravity, likely to move toward the rear side of the filter 121 and unlikely to move toward the front side, that is, toward the housing 95 side. Accordingly, by using the method as illustrated in FIG. 4B in attaching and detaching the filter unit 120, when the filter 121 is detached, spilling of the toner to the outside of the filter unit 120 may be further suppressed.

Furthermore, in the present exemplary embodiment, the inside of the filter unit 120 may be visible to an operator who is detaching the filter unit 120 when the operator observes the filter unit 120 from above. Thus, the operator may perform operation while checking the inside of the filter unit 120. The protrusions 122*c* and 122*d* in the lower end portion of the filter unit 120 are respectively inserted into the holes 95*c* and 95*d* formed in the housing 95. With this structure, the filter unit 120 is supported and the operator may more reliably perform operation. As a result, spilling of toner to the outside of the filter unit 120 may be further suppressed.

Second Exemplary Embodiment of Filter Unit

Next, a second exemplary embodiment of the filter unit 120 is described.

The appearance of the filter unit 120 according to the second exemplary embodiment is similar to that illustrated in FIG. 5. That is, the filter unit 120 includes the filter 121, the filter covering 122, and the joining member 123. However, the structures of components of the filter unit 120 according to the present exemplary embodiment are different from those of the filter unit 120 according to the first exemplary embodiment.

Figure 9:
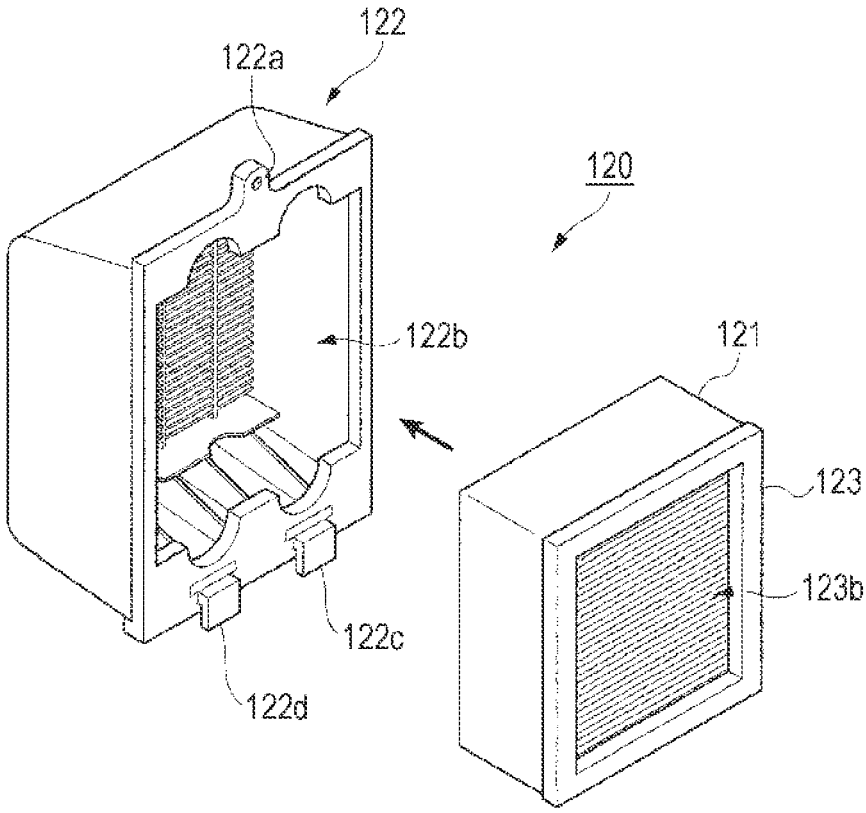
FIG. 9 illustrates a second structural example of the components of the filter unit.

FIG. 9 illustrates a second structural example of the components of the filter unit 120.

Unlike the filter covering 122 that includes two components as illustrated in FIG. 6, the filter covering 122 according to the present exemplary embodiment is a single component. That is, the covering member 122-1 and the covering frame 122-2 illustrated in FIG. 6 are integrated with each other in the present exemplary embodiment.

The joining member 123 is integrated with the filter 121 by being connected to the filter 121 with double-faced tape, adhesive, or the like. A structure, in which the joining member 123 and the filter 121 are connected to each other, is attached to and detached from the filter covering 122.

That is, as illustrated in FIG. 9, the filter 121 and the joining member 123 are housed in the filter covering 122 through the opening 122*b* formed on the housing 95 (see FIG. 5) side of the filter covering 122. The filter covering 122 is attached to the housing 95 with the filter 121 is housed in the filter covering 122. At this time, the filter 121 and the joining member 123 are pinched between the filter covering 122 and the housing 95, thereby the filter 121 is secured in the filter covering 122.

Figure 10:
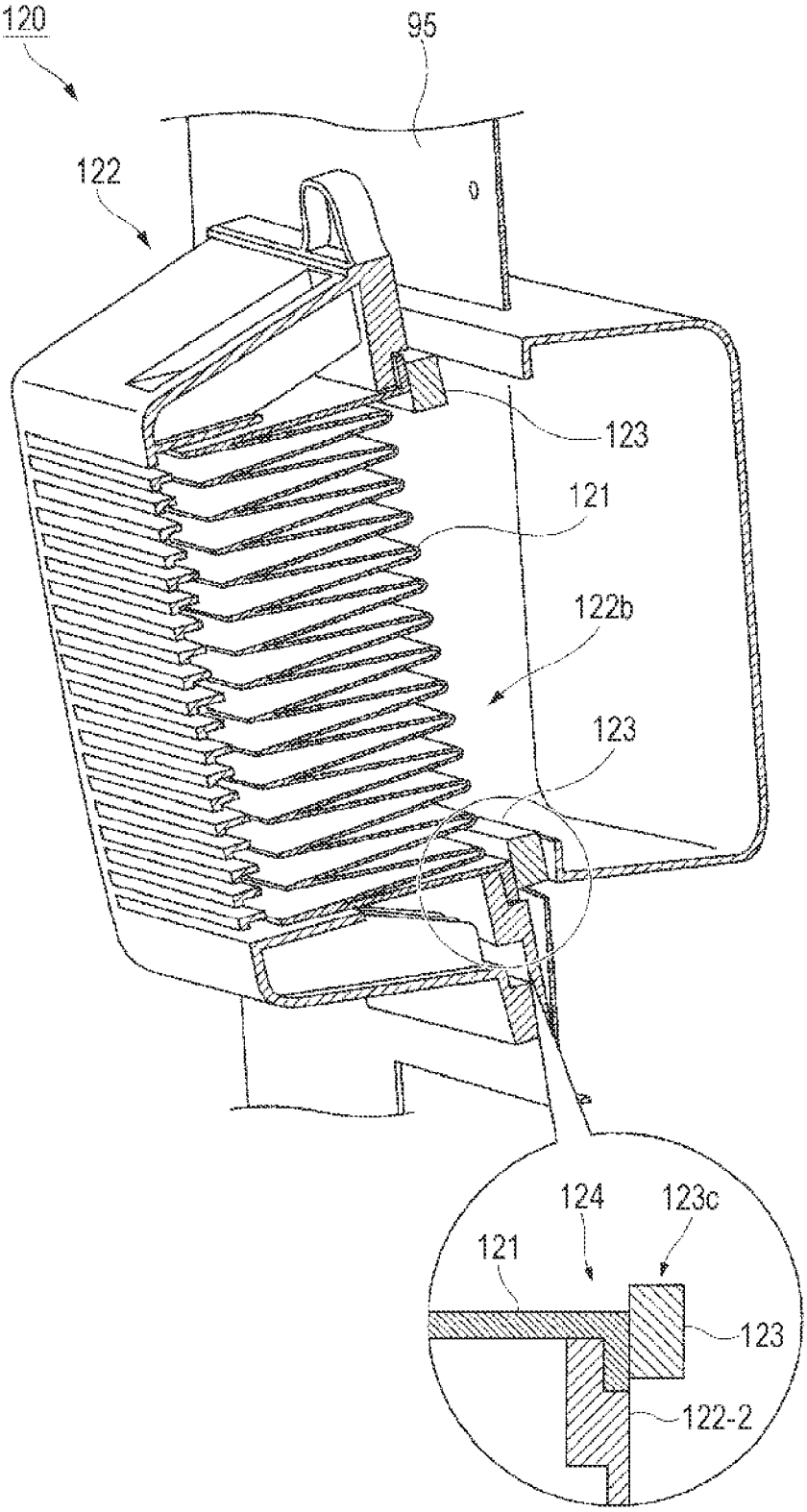
FIG. 10 is a sectional view of the filter unit according to an exemplary embodiment taken along line X-X in FIG. 4B.

FIG. 10 is a sectional view of the filter unit 120 according to the present exemplary embodiment taken along line X-X in FIG. 4B.

Also in the present exemplary embodiment, the joining member 123 has the projection 123*c* that projects beyond the edge of the opening 122*b* in a lower portion of the opening 122*b* toward an upper side of the filter covering 122. With the projection 123*c*, the space 124, in which toner is trapped, is formed.

Thus, also in the present exemplary embodiment, spilling of toner to the outside of the filter unit 120 may be suppressed.

In the present exemplary embodiment, the filter unit 120 has a structure similar to that illustrated in FIGS. 4A to 5 and the filter 121 has a structure similar to that illustrated in FIG. 8. Thus, also in the present exemplary embodiment, spilling of toner to the outside of the filter unit 120 may be further suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section that forms an image with toner;

a housing that houses the image forming section; and a toner collection mechanism that includes a suction unit that sucks the toner along with air, the toner leaving the image forming section and flying, and a separation unit that separates the toner from air, the toner being sucked by the suction unit, the separation unit of the toner collection mechanism including a separator that collects the toner and allows air to pass through the separator, a casing that houses the separator and has an upper side and an opening that has an edge and a lower portion, the toner and air flowing through the opening, and a joining unit that is disposed along the edge of the opening and joins the casing and the housing to each other, wherein the joining unit projects beyond the edge of the opening at least in the lower portion of the opening toward the upper side of the casing, thereby forming a space that allows the toner to be trapped in the space.

2. The image forming apparatus according to claim 1, wherein the casing includes a first casing member that has a hole that opens toward the housing, the first casing member housing the separator attached through the hole, and a second casing member that has one and the other sides, the one side facing the hole of the first casing member, the other side having the opening, the second casing member being attachable to and detachable from the first casing member while the second casing member is connected to the joining unit disposed along the edge of the opening.

3. The image forming apparatus according to claim 1, wherein the joining unit is connected to the separator and attached to and detached from the casing while the joining unit is connected to the separator.

4. The image forming apparatus according to claim 1, wherein the casing has a lower end portion, and wherein the separation unit is attached to and detached from the housing by being rotated about the lower end portion of the casing.

5. The image forming apparatus according to claim 1, wherein the separator is folded in an air flowing direction so as to have a zigzag shape and has a substantially horizontal surface in part of the separator.

6. A separation device for toner collection used with an image forming section that forms an image with toner and is housed in a housing, the separation device comprising:

a separator that collects the toner that leaves the image forming section and is flying, the separator allowing air to pass through the separator;

a casing that houses the separator and has an upper side and an opening that has an edge and a lower portion, the toner and air flowing through the opening; and a joining unit that is disposed along the edge of the opening and joins the casing and the housing to each other, wherein the joining unit projects beyond the edge of the opening at least in the lower portion of the opening toward the upper side of the casing, thereby forming a space that allows the toner to be trapped in the space.

* * * * *